US007116050B2

(12) United States Patent
Tamura et al.

(10) Patent No.: US 7,116,050 B2
(45) Date of Patent: Oct. 3, 2006

(54) METAL HALIDE LAMP, HEADLIGHT APPARATUS FOR VEHICLE USING THE SAME, AND METHOD OF MANUFACTURING METAL HALIDE LAMP

(75) Inventors: Nobuhiro Tamura, Yokosuka (JP); Seiko Kawashima, Yokosuka (JP); Takuya Honma, Yokosuka (JP); Hiromichi Kawashima, Imabari (JP); Hiroyuki Kato, Imabari (JP); Makoto Deguchi, Imabari (JP)

(73) Assignees: Harison Toshiba Lighting Corp., Imabari (JP); Toshiba Lighting & Technology Corporation, Tokyo (JP)

( * ) Notice: Subject to any disclaimer, the term of this patent is extended or adjusted under 35 U.S.C. 154(b) by 274 days.

(21) Appl. No.: 10/700,399

(22) Filed: Nov. 3, 2003

(65) Prior Publication Data

US 2005/0093455 A1 May 5, 2005

(51) Int. Cl.
*H01J 17/20* (2006.01)
*H01J 61/12* (2006.01)

(52) U.S. Cl. ..... 313/638; 313/643; 313/637

(58) Field of Classification Search ..... 313/638
See application file for complete search history.

(56) References Cited

U.S. PATENT DOCUMENTS 4,023,059 A * 5/1977 Anderson ..... 313/637
6,353,289 B1 * 3/2002 Ishigami et al. ..... 313/637
6,368,175 B1 * 4/2002 Horiuchi et al. ..... 313/636

FOREIGN PATENT DOCUMENTS

| | | |
|---|---|---|
| EP | 1274118 A2 | 1/2003 |
| JP | 11238488 | 8/1999 |
| JP | 11307048 | 11/1999 |
| JP | 11329350 | 11/1999 |
| JP | 516901 | 12/2000 |
| JP | 357818 | 12/2001 |
| WO | WO98/07537 | 2/1998 |

OTHER PUBLICATIONS

Apr. 29, 2005 official Communication and European Search Report in connection with corresponding European Patent Appl. No. EP 03 25 7051 (Exhibit B).

* cited by examiner

*Primary Examiner*—Nimeshkumar D. Patel
*Assistant Examiner*—Natalie K. Walford
(74) *Attorney, Agent, or Firm*—John P. White, Esq.; Cooper & Dunham LLP

(57) ABSTRACT

A metal halide lamp comprises a discharge container including a discharge space and a pair of sealing sections. A discharge medium containing a metal halide and a rare gas and essentially free from mercury is sealed in the discharge container. A pair of electrodes are arranged to face each other within the discharge space, and the side edge portions on the side of the proximal end portion of these electrodes are held by the sealing sections. The amount of water contained in the metal halide, i.e., the light-emitting material, included in the metal halide lamp essentially free from mercury, i.e., Hg-less metal halide lamp, is controlled to 50 ppm or less.

13 Claims, 1 Drawing Sheet

METAL HALIDE LAMP, HEADLIGHT APPARATUS FOR VEHICLE USING THE SAME, AND METHOD OF MANUFACTURING METAL HALIDE LAMP

BACKGROUND OF THE INVENTION

1. Field of the Invention

The present invention relates to a metal halide lamp free from Hg, a headlight apparatus for vehicles using the particular metal halide lamp, and a method of manufacturing the metal halide lamp free from Hg.

2. Description of the Related Art

A metal halide lamp is a lamp including a light emitting tube having various metal halides sealed therein together with mercury and a rare gas for improving the light emitting efficiency and the color rendering properties of the lamp. The metal halide lamp, which is featured in its high efficiency and high color rendering properties, is widely used for general illumination such as shop illumination and road illumination. Further, a metal halide lamp has come to be used as a light source in the headlights for a vehicle.

As described above, mercury is generally used as a part of the discharge medium included in the conventional metal halide lamp. However, environmental problems have become serious nowadays, with the result that it is required in the field of illumination to decrease the amount of use of mercury giving a heavy environmental burden. Further, it is important to eliminate mercury completely from the lamp. Such being the situation, several measures have been proposed to date for eliminating mercury from the metal halide lamp.

For example, proposed in Japanese Patent Disclosure (Kokai) No. 11-238488 is a metal halide lamp having a first metal halide, i.e., a halide of the main light emitting substance such as scandium (Sc), sodium (Na) or a rare earth element, and a second halogenated metal, i.e., a halide of, for example, zinc (An), manganese (Mn), aluminum (Al) or gallium (Ga) having a high vapor pressure, sealed therein together with a rare gas. Also, disclosed in Japanese Patent Disclosure No. 11-307048 is a metal halide lamp further having a third metal halide, i.e., a halide of, for example, yttrium (Y) or indium (In), sealed therein. Each of these prior arts is intended to deal with various problems arising from the non-use of mercury.

In the metal halide lamp that does not use Hg, i.e., an Hg-less metal halide lamp, new problems arise as described below based on the situation that Hg is not used as a part of the discharge medium. Specifically, in the Hg-less metal halide lamp, the cloudiness phenomenon or the blackening phenomenon tends to be brought about at an earlier stage, compared with the conventional metal halide lamp having Hg sealed therein, with the result that it is difficult to obtain a practically sufficient lamp life in the Hg-less metal halide lamp. To be more specific, the lamp life obtained in the Hg-less metal halide lamp is about 500 hours, compared with about 3000 hours for the conventional metal halide lamp having Hg sealed therein.

It is known in the art that the life of the discharge lamp is affected by the impurities such as water present in the lamp. For example, disclosed in Japanese Patent Disclosure No. 11-329350 is a high pressure discharge lamp or a discharge lamp such as a metal halide lamp, in which the amount of the OH groups contained in the quartz glass constituting the discharge container is lowered to, for example, 10 ppm or less and, at the same time, a rare gas having hydrogen, oxygen and the compound thereof ($H_2O$) removed therefrom, e.g., a rare gas having the water content lowered to 5 ppm or less in the molar ratio, is sealed in the discharge container. Further, disclosed in Japanese Patent Disclosure No. 2001-357818 is a metal halide lamp having Hg sealed therein, in which the water content of the gas sealed in the discharge space is lowered to 130 ppm or less.

However, in the Hg-less metal halide lamp, it is impossible to prolong sufficiently the life of the lamp by simply decreasing the amount of the OH groups contained in the quartz glass and by decreasing the amount of water contained in the rare gas, with the result that the Hg-less metal halide lamp having a long life cannot be obtained with high reproducibility. It is considered reasonable to understand that the decrease of the lamp life of the Hg-less metal halide lamp is affected by the water contained in the metal halide sealed in the discharge container as a light-emitting material.

To be more specific, a light-emitting material containing a metal halide having a high vapor pressure, i.e., the halide of Zn, Mn or Al referred to above, is used in the Hg-less metal halide lamp, so as to permit the light-emitting material to ensure the required lamp voltage in place of mercury. In the Hg-less metal halide lamp of this type, the amount of the metal halide sealed in the lamp is markedly larger than that sealed in the metal halide lamp having Hg sealed therein. It follows that, even if the metal halide raw materials used as the materials for manufacturing the metal halide lamps are equal to each other in water content, it is considered reasonable to understand that the amount of water released from the metal halide into the discharge space for the Hg-less metal halide lamp is larger than that for the metal halide lamp having Hg sealed therein.

Further, where a required lamp voltage is ensured by using a metal halide having a high vapor pressure, the amount of the halogen gas such as a free iodine gas is increased with increase in the concentration of the metal halide caused by the evaporation of the metal halide during lighting. It is considered reasonable to understand that, if the halogen gas such as a free iodine gas is present in a large amount, erosion and deposition of $SiO_2$ (migration phenomenon of Si) are caused to take place in the quartz glass constituting the discharge container so as to bring about the cloudiness phenomenon (blackening phenomenon). Incidentally, in the metal halide lamp having Hg sealed therein, $HgI_2$, for example, is formed so as to suppress the generation of halogen gas such as free iodine gas.

On the other hand, measures for decreasing, for example, the water content and the oxygen content are taken in respect of the metal halide itself used as the light-emitting material of the metal halide lamp, as disclosed in, for example, Japanese Patent Open Publication (Toku-hyo) No. 2000-516901. To be more specific, disclosed in this prior art are metal halide particles and metal halide pellets having the oxygen content lowered to 200 ppm or less and having the hydrogen content lowered to 100 ppm or less. These metal halide particles or pellets are manufactured by using a manufacturing apparatus which permits preventing an increase in the water content, under an environment that, for example, the dew point is not higher than −50° C.

However, even in the case where the particles or pellets of the metal halide referred to above are used as a light-emitting material of the Hg-less metal halide lamp, it is impossible to improve the lamp life with a high reproducibility without fail. It should be noted in this connection that the moisture absorption tends to take place not only in the manufacturing process of the Hg-less metal halide lamp but also in the after-treating process and the transfer process of the manufactured Hg-less metal halide lamp so as to increase the water content. This tendency is particularly high when it comes to a light-emitting material containing a metal halide having high deliquescent properties such as $HgI_2$, with the result that it is highly possible for the water content to be increased at the stage of sealing the light-emitting material in the metal halide lamp. It follows that the Hg-less metal halide lamp manufactured by using such a light-emitting material tends to have a short life.

As described above, in the Hg-less metal halide lamp, the decrease in the lamp life caused by the cloudiness phenomenon or the blackening phenomenon remains to be a serious problem to be solved. It is considered reasonable to understand that the decrease of the lamp life is affected by the water content in the discharge space during lighting. However, it is impossible to improve the lamp life of the Hg-less metal halide lamp with a high reproducibility by simply decreasing the amount of the OH groups in the quartz glass and by decreasing the water content in the rare gas as in the prior art. Such being the situation, it is of high importance to overcome the difficulty inherent in the Hg-less metal halide lamp so as to improve the life of the Hg-less metal halide lamp by suppressing an increase in the water content during lighting of the lamp.

BRIEF SUMMARY OF THE INVENTION

An object of the present invention is to provide a Hg-less metal halide lamp, in which the increase in the water content in the lamp lighting stage is suppressed so as to improve the lamp life, a headlight apparatus for a vehicle using the particular Hg-less metal halide lamp, and a method of manufacturing a metal halide lamp free from Hg.

The metal halide lamp according to a first embodiment of the present invention comprises a discharge container including a discharge space and sealing sections formed at both edges of the discharge space; a pair of electrodes arranged to face each other within the discharge space and held in the sealing sections; and a discharge medium sealed in the discharge container, containing a light-emitting material formed of a metal halide and a rare gas, and essentially free from mercury, wherein the amount of water contained in the metal halide in the extinguishing stage of the metal halide lamp is not larger than 50 ppm.

The definition and the technical significance of the technical terms used in the first embodiment described above and each of the other embodiments of the present invention are as follows unless otherwise specified.

The discharge container is formed of a refractory and light-transmitting hermetic container including a discharge space and sealing sections formed at the both edge portions of the discharge space. It is possible for the hermetic container to be formed of any material as far as the material exhibits a fire resistance capable of sufficiently withstanding the ordinary operating temperature of the discharge lamp and is capable of guiding to the outside the visible light generated by the discharge and having a desired wavelength region. For example, it is possible for the hermetic container to be formed of a quartz glass and ceramic materials such as a light-transmitting alumina and YAG as well as single crystals thereof. Incidentally, it is possible to form a light-transmitting film resistant to halogen or metal on the inner surface of the hermetic container or to modify the inner surface of the hermetic container, as required. Also, it is appropriate to set the inner volume of the discharge container (or the volume of the discharge space) to fall within a range of, for example, between 0.02 and 0.06 mL (milliliter).

Incidentally, the present invention is featured in that the amount of water contained in the metal halide is set at 50 ppm or less. It is also desirable for the water content to be lowered in the materials constituting the lamp other than the metal halide. The material of the discharge container other than the metal halide, the material tending to have a high water content, includes quartz glass. Therefore, it is desirable to apply in advance a vacuum heat treatment to the discharge container for decreasing the water content including the OH groups attached to the glass surface.

A pair of electrodes are arranged to face each other within the discharge space and embedded partly in the sealing sections of the discharge container so as to be held by the discharge container. It is possible for the metal halide lamp of the present invention to be constructed such that the metal halide lamp is lit by any of the AC current and the DC current, and the shape and the material of the electrode are selected in conformity with the lighting system employed. Also, it is practically desirable for the distance between the pair of electrodes to be 5 mm or less. If the distance between the electrodes exceeds 5 mm, the metal halide lamp fails to form a point source of light and, thus, the focus characteristics of the optical system are rendered poor. It follows that, where the metal halide lamp is used as a light source of the headlight for a vehicle, the brightness of the illuminated plane is lowered. Incidentally, the distance between the electrodes referred to above corresponds to that of a short arc type metal halide lamp. However, the present invention is not necessarily limited to this particular case. In other words, it is possible for the distance between the electrodes referred to above to correspond to that of a long arc type metal halide lamp.

The discharge medium, which is sealed in the discharge container, includes a light-emitting material having a metal halide and a rare gas. The halides of various metals can be used as the metal halides. For example, a halide of a metal contributing mainly to the light emission is used as the metal halide. In the metal halide lamp of the present invention, first and second metal halides are sealed in the discharge container. Halides of a single or a plurality of metal elements selected from the group consisting of sodium (Na), scandium (Sc) and rare earth elements are used as the first metal halides. It should be noted that Na and Sc are light-emitting materials of a particularly high efficiency.

It is possible for the light-emitting material used in the present invention to include a second metal halide together with the first metal halide. The second metal halide includes a single or a plurality of halides of metals which have a high vapor pressure and are unlikely to emit light of a visible region, compared with the metals of the first halides. The metal that is unlikely to emit light of a visible region has an energy level higher than that of the metal component of the first metal halide and is contained in the discharge container under the state that the metal element of the first metal halide mainly emits light. By the addition of the particular second metal halide, it is possible to obtain a lamp voltage close to that of the metal halide lamp containing Hg. It follows that it is possible to improve the electric characteristics and the light-emitting characteristics of the Hg-less metal halide lamp. The second metal halide also permits improving the chromaticity.

It is possible for the second metal halide to be provided by halides of a single or a plurality of metal elements selected from the group consisting of, for example, zinc (Zn), magnesium (Mg), iron (Fe), cobalt (Co), chromium (Cr), nickel (Ni), manganese (Mn), aluminum (Al), antimony (Sb), beryllium (Be), rhenium (Re), gallium (Ga), titanium (Ti), zirconium (Zr) and hafnium (Hf).

It is also possible for the light-emitting material to include a third metal halide, which is provided by halides of a single or a plurality of metal elements selected from the group consisting of indium (In), tin (Sn) and cesium (Cs). The halide of In contributes to the improvement of the chromaticity of the emitted light. The halide of Sn is added as a component contributing to the function of suppressing the generation of the free halogen elements. Further, the halide of Cs is added as a component contributing to the correction of the arc temperature distribution so as to lower the heat loss.

The light-emitting material used in the present invention includes a mixture of the first metal halide and the second metal halide, which may further contain the third metal halide. However, the light-emitting material used in the present invention is not necessarily limited to the mixture noted above. The present invention is adapted for a metal halide lamp containing the light-emitting material formed of the metal halides noted above in an amount of at least 2 mg, preferably at least 10 mg, per mL of the inner volume of the discharge container. It should be noted that, in the metal halide lamp having a relatively large amount of the metal halides sealed therein as described above, the lamp life is greatly affected by particularly the amount of water contained in the metal halides.

It is most desirable to use iodine (I) having a high reactivity as the halogen element contained in the metal halide. It is also possible to use bromine (Br), chlorine (Cl), and fluorine (F) in the order mentioned in view of the reactivity of these halogen elements. In short, it is possible to use any of the halogen elements as the halogen component of the metal halide used in the present invention. It is also possible to use in combination different halogen compounds. For example, it is possible to use an iodide and a bromide in combination.

Concerning the sealing amount of the metal halide, it is possible to seal the first metal halide contributing mainly to the light emission in an amount of, for example, 2 to 110 mg per mL of the inner volume of the discharge container. Preferably, the first metal halide should be sealed in the discharge container in an amount of 5 to 35 mg per mL of the inner volume of the discharge container. Where the amount of the first metal halide falls within the range noted above, it is possible to promote the rise of the light flux and to stabilize the color of the light. On the other hand, the second metal halide can be sealed in the discharge container in an amount of 1 to 200 mg per mL of the inner volume of the discharge container, and it is desirable for the amount of the second metal halide to be sealed in the discharge container in an amount of 2 to 50 mg per mL of the inner volume of the discharge container. The amounts of the other halides are controlled appropriately.

The rare gas sealed in the discharge container acts as a buffer gas in the start-up time and, at the same time, contributes to the main light emission immediately after the start-up.

In general, the rare gas used in the present invention is not particularly limited as far as the rare gas is incapable of permeating through the hermetic container. However, since neon (Ne) tends to permeate through the quartz glass, it is desirable to use argon (Ar), krypton (Kr), or xenon (Xe) as the rare gas in the case where the hermetic container is formed of quartz glass. Where the light emission immediately after the start-up is dependent on the rare gas, it is most desirable to use a xenon gas as the rare gas because the xenon gas exhibits the highest light emission efficiency.

Also, if the sealing pressure of the rare gas is increased, the lamp voltage of the metal halide lamp is increased so as to increase the lamp input relative to the same lamp current, with the result that the rising characteristics of the light flux can be improved. The situation that the rising characteristics of the light flux are satisfactory is convenient in any object of the use. Particularly, the good rising characteristics of the light flux are important in the headlight apparatus for a vehicle and in the liquid crystal projector. It is desirable for the rare gas to be sealed in the discharge container at a pressure not lower than, for example, 3 atmospheres, particularly at a pressure falling within a range of between 5 and 15 atmospheres.

Mercury is not essentially sealed in the metal halide lamp of the present invention. The expression "not essentially sealed" implies that it is acceptable for mercury to be sealed in the discharge container in an amount smaller than 2 mg, more desirably not larger than 1 mg, per mL of the inner volume of the discharge container. However, in terms of the environmental problem, it is desirable for mercury not to be sealed at all in the discharge container. Where the electric characteristics of the discharge lamp are maintained by the mercury vapor as in the prior art, mercury is sealed in an amount of 20 to 40 mg or at least 50 mg, per mL of the inner volume of the discharge container. The amount of mercury of the present invention is essentially small compared to the conventional metal halide lamp.

The amount of water contained in the metal halide used in the present invention denotes the amount of water contained in the solid metal halide in the extinguishing stage of the metal halide lamp. In the present invention, the particular water content of the metal halide is defined to be 50 ppm or less. The water content of the metal halide used in the metal halide lamp of the present invention is measured as follows. Specifically, the metal halide lamp under the extinguished state is divided within a hermetically closed heated cell, i.e., divided under the state that the metal halide lamp is not brought into contact with the air atmosphere, so as to heat the divided metal halide lamp under the state that the metal halide present in the form of a solid is exposed within the cell so as to evaporate water, and the amount of water thus evaporated is measured by the Karl Fischer technique or the FT-IR method. In measuring the amount of the evaporated water by the technique referred to above, it is possible to judge whether the water is generated by the heating from the metal halide or from the discharge container made of, for example, quartz glass. In this case, the water generated under the heating temperature falling within a range of between room temperature and 800° C. is assumed to be the water contained in the metal halide.

As described previously, in the Hg-less metal halide lamp, the lamp voltage is ensured by using a light-emitting material containing a metal halide having a high vapor pressure, i.e., the second metal halide. It should be noted that, since the evaporated concentration of the metal halide in the lighting stage is determined by the vapor pressure of each of the metal halides, the amount of the halogen gas such as a free iodine gas is also increased in the Hg-less metal halide lamp referred to above with increase in the evaporated concentration of the metal halide. To be more specific, it has been clarified that, in the Hg-less metal halide lamp containing the second metal halide, the halogen vapor pressure was increased to a level about 10 times as high as that in the metal halide lamp having Hg sealed therein.

If the halogen gas such as a free iodine gas is present in the discharge container in a large amount, it is considered reasonable to understand that the erosion and deposition of $SiO_2$ (i.e., migrating phenomenon of Si) are brought about in the quartz glass forming the discharge container. To be more specific, the erosion of $SiO_2$ based on the reaction of $SiO_2+2I_2 \rightarrow SiI_4\uparrow$ and the deposition of $SiI_4$ based on the decomposing reaction of $SiO_2$ are considered to take place so as to bring about the clouding phenomenon. Further, if $SiI_4$ generated by the decomposing reaction of $SiO_2$ reacts with the electrode, the metal component of the electrode is considered to be scattered so as to be attached to the inner wall surface of the discharge container, thereby bringing about the blackening phenomenon.

Since the reactivity of the migrating reaction of Si described above is enhanced by the water present in the discharge space, the clouding phenomenon and the blackening phenomenon tend to be generated easily in the Hg-less metal halide lamp containing a large amount of the halogen gas such as a free iodine gas. Further, it is considered reasonable to understand that the water present in the discharge space permits increasing the halogen gas such as a free iodine gas. Since the amount of the metal halide sealed in the Hg-less metal halide lamp is larger than that sealed in the metal halide lamp having Hg sealed therein, the amount of the water released into the discharge space in the Hg-less metal halide lamp is rendered larger than that in the metal halide lamp having Hg sealed therein even if the same amount of water is contained in the metal halide in these metal halide lamps. It follows that the luminous flux maintenance rate is lowered in an earlier stage in the conventional Hg-less metal halide lamp.

Such being the situation, the amount of water contained in the metal halide (solid metal halide) included in the metal halide lamp in the extinguished state of the lamp is controlled to be 50 ppm or less in the present invention. By controlling the amount of water contained in the metal halide at 50 ppm or less in this fashion, it is possible to lower the amount of water released from the metal halide into the discharge space in the lighting stage of the lamp even in the Hg-less metal halide lamp having a relatively large amount of the metal halide sealed therein. Since the migrating reaction of Si referred to above can be suppressed by decreasing the amount of water released from the metal halide, it is possible to suppress the decrease in the luminous flux maintenance rate based on the clouding phenomenon and the blackening phenomenon. In other words, it is possible to prolong the life of the Hg-less metal halide lamp.

The effect of improving the life of the metal halide lamp based on the decrease in the amount of water contained in the metal halide referred to above can be prominently produced by, particularly, the Hg-less metal halide lamp, in which a large amount of the metal halide is sealed in the discharge container and the vapor pressure of the halogen gas such as a free iodine gas tends to be increased. Such being the situation, the present invention can be applied appropriately to a metal halide lamp containing a light-emitting material containing a metal halide in an amount of at least 2 mg, preferably at least 10 mg, per mL of the inner volume of the discharge container. Also, it is more desirable for the amount of water contained in the metal halide included in the metal halide lamp of the present invention to be not larger than 20 ppm. In this case, it is possible to further prolong the life of the metal halide lamp. Incidentally, since it is very difficult to remove completely the water contained in the metal halide in the commercial manufacturing process, it is practically acceptable for the water to be contained in an amount falling within a range of between 0.1 ppm and 50 ppm, further in an amount not larger than 20 ppm.

Another embodiment of the present invention is featured in that the light-emitting material contains a first metal halide including a halide of at least one metal selected from sodium, scandium and a rare earth element and a second metal halide including a halide of at least one kind of metal selected from the group consisting of zinc, magnesium, iron, cobalt, chromium, nickel, manganese, aluminum, antimony, beryllium, rhenium, gallium, titanium, zirconium and hafnium. The metal halide lamp of this embodiment defines the construction of the light-emitting material that permits producing the function of the present invention, i.e., the improvement in the life of the metal halide lamp based on the decrease of the water amount contained in the metal halide, more prominently.

To be more specific, in the case of using the second metal halide having a high vapor pressure, i.e., a halide of at least one metal selected from the group consisting of Zn, Mg, Fe, Co, Cr, Ni, Mn, Al, Sb, Be, Re, Ga, Ti, Zr and Hf, in addition to the first metal halide, i.e., a halide of at least one metal selected from the group consisting of Na, Sc and a rare earth element, the evaporated concentration of the metal halide is increased so as to increase the generated amount of the halogen gas such as a free iodine gas. Even in such a case, it is possible to suppress with a high reproducibility the migrating phenomenon of Si derived from the free iodine gas, by decreasing the amount of water contained in the metal halide based on the technical idea of the present invention.

Another embodiment of the present invention is featured in that the metal halide includes at least a halide of zinc. Since zinc halide $ZnI_2$ exhibits the deliquescent properties, the amount of water contained in the metal halide tends to be increased in the metal halide lamp using a light-emitting material including the zinc halide. Even in such a case, it is possible to prolong with a high reproducibility the life of the metal halide lamp by setting the amount of the water contained in the metal halide at 50 ppm or less in the metal halide lamp.

Another embodiment of the present invention is featured in that the raw material of the metal halide containing water in an amount not larger than 100 ppm is sealed in the discharge container. It should be noted that the raw material of the metal halide referred to above implies pellets or particles of a mixture between the first metal halide and the second metal halide, which may further contain the third metal halide as required.

It is possible to set the amount of water contained in the metal halide included in the metal halide lamp at 50 ppm or less with a high reproducibility by setting the amount of water contained in the raw material of the metal halide at 100 ppm or less and by sealing the particular raw material in the discharge container.

It is considered reasonable to understand that, since the water contained in the raw material of the metal halide is partly adsorbed by the quartz glass or is decomposed, the amount of water contained in the metal halide included in the metal halide lamp is rendered smaller than the amount of water contained in the raw material. The amount of water contained in the raw material of the metal halide can be measured within a hermetically closed heated cell by the Karl Fischer technique or the FR-IR method, or can be measured by a heating removal type mass analyzing apparatus.

Another embodiment of the present invention is featured in that a vacuum heat treatment is applied to the raw material of the metal halide. The raw material of the metal halide used in the present invention is not particularly limited in respect of, for example, the manufacturing process and the treating process as far as the amount of water contained in the raw material is not larger than 100 ppm. It should be noted in this connection that the amount of water contained in the raw material of the metal halide can be set at 100 ppm or less with a high reproducibility by applying, particularly, a vacuum heat treatment to the raw material of the metal halide.

To be more specific, it is difficult to lower the water content with a high reproducibility by simply controlling the manufacturing conditions of the raw material of the metal halide. It should be noted that the manufactured raw material of the metal halide tends to absorb moisture in the after-treatment or in the transfer process so as to increase the water content of the raw material of the metal halide. On the other hand, the water content of the metal halide can be lowered with a high reproducibility by applying a vacuum heat treatment to the raw material of the metal halide and by sealing the treated raw material of the metal halide in the discharge container without exposing the raw material to the air atmosphere.

In the present invention, the vacuum heat treatment can be applied to the raw material of the metal halide under a vacuum atmosphere not higher than $1\times10^{-3}$ Pa and under temperatures falling within a range of between 300° C. and 350° C. Further, it is desirable to apply the vacuum heat treatment for about 30 minutes to 2 hours. It is also possible to apply the vacuum heat treatment before the raw material of the metal halide is put in the discharge container, followed by sealing the treated raw material of the metal halide in the discharge container without exposing the treated raw material to the air atmosphere. Alternatively, it is possible to put the raw material of the metal halide in the discharge container, followed by applying the vacuum heat treatment to the raw material under an open state and subsequently sealing the discharge container.

More preferably, the water content of the metal halide can be lowered to 100 ppm or less by applying a heat treatment to the metal halide raw material under an inert gas atmosphere, particularly, a rare gas atmosphere, and under temperatures of 300 to 350° C. It is desirable for the heating time to be not longer than 10 minutes. The heat treatment under the inert gas atmosphere can be applied before the raw material of the metal halide is put in the discharge container, followed by sealing the treated raw material in the discharge container without exposing the treated raw material to the air atmosphere. Alternatively, it is possible to put the raw material of the metal halide in the discharge container, followed by sealing a sealing an inert gas in the discharge container and subsequently applying a heat treatment to the raw material within the discharge container under the inert gas atmosphere. In this case, the discharge container is sealed after application of the heat treatment to the raw material of the metal halide.

Another embodiment of the present invention is featured in that the metal halide contains an excessively large amount of the metal component compared with the stoichiometric amount. The metal halide rich in the metal component consumes, for example, the free iodine gas generated within the discharge container, i.e., plays the role of bringing the free iodine element back into the metal halide. It follows that it is possible to suppress further the migrating phenomenon of Si, which is derived from the presence of a halogen gas such as a free iodine gas, as well as the clouding phenomenon and the blackening phenomenon caused by the migrating phenomenon of Si. The metal halide rich in the metal component can be obtained by applying the vacuum heat treatment to the raw material of the metal halide noted above because the halogen element is somewhat released from the metal halide by the vacuum heat treatment. Incidentally, where the halogen element is excessively released from the metal halide, it is possible to control appropriately the metal/halogen ratio by applying a heat treatment while allowing the halogen gas to leak slowly into the heat treating container.

If the amount of the metal component is excessively large in the metal halide rich in the metal component noted above, it is possible to fail to obtain the characteristics such as a vapor pressure inherent in the metal halide. Such being the situation, it is desirable for the metal component to be contained excessively within a range of at most 30% relative to the stoichiometric composition. It suffices for the metal component to be contained in an excessively large amount relative to the stoichiometric composition. In order to permit, for example, the free iodine element to be consumed more effectively, however, it is desirable for the metal component to be contained in the metal halide in an excessively large amount within a range of at least 1% relative to the stoichiometric composition. For example, when it comes to sodium iodide (NaI) having a stoichiometric composition (molar ratio) of 1:1, it is desirable for the actual composition within the metal halide lamp to be $Na_{1.01}I$ to $Na_{1.3}I$. Similarly, when it comes to zinc iodide ($ZnI_2$) having a stoichiometric composition (molar ratio) of 1:2, it is desirable for the actual composition within the metal halide lamp to be $Zn_{1.01}I_2$ to $Zn_{1.3}I_2$. This is also the case with the other metal halides.

Further, still another embodiment of the present invention is directed to a headlight apparatus for a vehicle, comprising a metal halide lamp according to any of the embodiments described above and a headlight apparatus body for a vehicle, the apparatus body having an optical axis extending in the longitudinal direction of the discharge container included in the metal halide lamp. In the headlight apparatus for a vehicle according to the present invention, it is possible to improve the life characteristics based on the metal halide lamp of the present invention, with the result that it is possible to improve markedly the capability of practically using the Hg-less headlight apparatus for a vehicle. Incidentally, the term "headlight apparatus body for a vehicle" referred to above denotes the entire structure resulting from removal of the metal halide lamp from the headlight apparatus for a vehicle.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the present invention, and together with the general description given above and the detailed description of the preferred embodiments given below, serve to explain the principles of the present invention.

DETAILED DESCRIPTION OF THE INVENTION

Some embodiments of the present invention will now be described.

Figure 1:
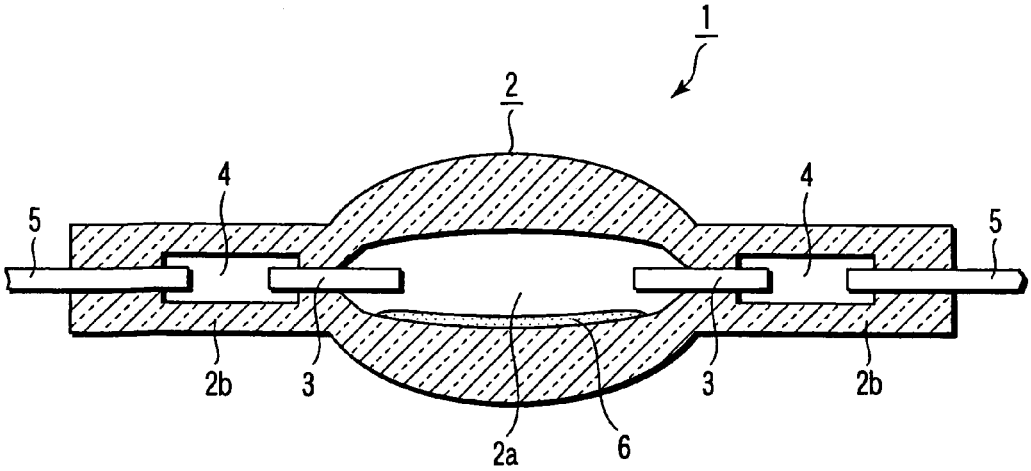
FIG. 1 is a cross sectional view showing the construction of a Hg-less metal halide lamp according to an embodiment of the present invention.

FIG. 1 is a cross sectional view schematically showing the construction of a Hg-less metal halide lamp 1 according to a first embodiment of the present invention. As shown in the drawing, the metal halide lamp 1 comprises a discharge container 2, a pair of electrodes 3, a pair of sealing metal foils 4, a pair of external lead wires 5, and a light-emitting material 6 sealed in the discharge container 2.

The metal halide lamp 1 comprises the discharge container 2 which is a hermetic and hollow spindle-shaped container made of quarts glass. A slender discharge space 2*a* is formed inside the discharge container 2, and a pair of sealing sections 2*b* are integrally formed in the both edges of the discharge space 2*a*. The pair of electrodes 3 are arranged to face each other within the discharge space 2*a*. The side edge portions on the proximal end portions of these electrodes 3 are embedded within the sealing sections 2*b* so as to be supported at the prescribed positions within the discharge space 2*a*.

Also, the side edge portion on the proximal end portion of each of the electrodes 3 is joined to the sealing metal foil 4 formed of, for example, a Mo foil on the side of one edge. On the other hand, one edge portion of external lead wire 5 is connected to the sealing metal foil 4 on the side of the other edge. The other edge portion of the external lead wire 5 extends to the outside of the discharge container 2. The sealing metal foil 4 is hermetically sealed by the sealing sections 2*b* under the state that the electrode 3 and the external lead wire 5 are joined to the sealing metal foil 4. The hermetic state of the discharge container 2 is maintained by allowing the sealing metal foil 4 to be tightly brought into contact with the quartz glass of the sealing section 2*b*.

The light-emitting material 6 including a metal halide used as a discharge medium is sealed in the discharge container 2 together with a rare gas. The discharge medium is essentially free from Hg. It is possible to use various metal halides as the light-emitting material 6. For example, it is possible to use a mixed light-emitting material containing a single kind of or a plurality of first metal halides and the second metal halide described previously. It is possible for the mixed light-emitting material to contain further the third metal halide described previously. The first metal halide contributes mainly to the light emission and consists of a halide of at least one metal selected from the group consisting of Na, Sc and a rare earth metal.

The light-emitting material 6 including the metal halides is sealed in the discharge container 2 in an amount of at least 2 mg, preferably at least 10 mg, per mL of the inner volume of the discharge container 2. When the metal halide lamp 1 is extinguished, the light-emitting material 6 is in the form of a solid material and is attached to the inner wall surface of the discharge container 2. In the Hg-less metal halide lamp 1 in this embodiment, the amount of water contained in the metal halides constituting the light-emitting material 6 is controlled at 50 ppm or less when measured under the extinguished state of the metal halide lamp 1. In order to permit the amount of water contained in the metal halide 6 in the Hg-less metal halide lamp 1 to be 50 ppm or less, it is desirable to use the raw material of the metal halide containing water in an amount of 100 ppm or less. In this case, it is possible to realize the water content of the metal halide 6 described above with a high reproducibility. Also, the raw material of the metal halide having the water content not higher than 100 ppm can be obtained with a high reproducibility by applying the vacuum heat treatment.

According to the Hg-less metal halide lamp 1 described above, the amount of water contained in the metal halide 6 under the extinguished state of the metal halide lamp 1 is controlled to 50 ppm or less. As a result, it is possible to lower the amount of water released from the light-emitting material including the metal halide 6 during the lighting stage of the metal halide lamp 1. It follows that it is possible to suppress the generation of the clouding phenomenon and the blackening phenomenon derived from the migrating reaction of Si even in the Hg-less metal halide lamp 1 in which a large amount of the light-emitting material including the metal halide 6 is sealed and the vapor pressure of the halogen gas such as a free iodine gas tends to be increased. Such being the situation, it is possible to suppress the reduction in the rate of maintaining the luminous flux of the Hg-less metal halide lamp 1 so as to markedly improve the life of the metal halide lamp 1.

Specific Examples of the Hg-less metal halide lamp 1 according to the first embodiment of the present invention and the results of evaluation thereof will now be described.

EXAMPLES 1 TO 3 AND COMPARATIVE EXAMPLE 1

A hermetic container made of quartz glass and having an outer diameter of 6 mm, an inner diameter of 2.7 mm, an inner volume of about 0.03 mL, and a length of the light-emitting space of 6 mm was used as the discharge container 2. Also, a W electrode having an outer diameter of 0.35 mm was used as the electrode 3, the protruding length of the sealing section 2*b* was set at 1.4 mm, and the distance between the pair of the electrodes 3 was set at 4.2 mm. A mixture of metal halides consisting of $ScI_3$, NaI and $ZnI_2$, which was included in the discharge medium, was sealed in the discharge container 2. The mixing ratio by mass of these metal halides, i.e., the ratio of $ScI_3$:NaI:$ZnI_2$, was set at 1:2:1, and the sealing amount of the mixture was set at 0.3 mg. High quality chemicals low in the water content were used as the metal halides.

A plurality of raw materials of the light-emitting material consisting of the mixture of the metal halides noted above were prepared and, after subjected to the vacuum heat treatment (VT treatment) as shown in Table 1, these raw materials were sealed in the discharge container 2. The vacuum heat treatment was applied to the raw material of the metal halide before the raw material was put in the discharge container 2 and, after the amount of water was measured by the Karl Fischer technique referred to previously, the treated raw material was sealed in the discharge container 2 without exposing the treated raw material to the air atmosphere. The amount of water contained in the raw material of the metal halide (amount before sealing/amount after vacuum heat treatment) was as shown in Table 1. A Xe gas having a pressure of 10 atms. was also sealed as a rare gas in the discharge container 2. Incidentally, Comparative Example 1 shown in Table 1 is directed to the case where the raw material of the metal halide having a relatively high water content was used without applying a vacuum heat treatment to the raw material. In Comparative Example 1, the amount of water contained in the raw material of the metal halide was measured as in the Example of the present invention, followed by sealing the raw material in the discharge container 2 without exposing the raw material to the air atmosphere.

The Hg-free metal halide lamp for each of Examples 1 to 3 and Comparative Example 1 was lit under a lamp power of 40 W so as to measure the luminous flux maintenance rate after the lighting for 2000 hours for each of the metal halide lamps. Also, in each of the Hg-less metal halide lamps 1 after the lighting test, a mixture of the metal halides (light emitting material 6) attached in the form of a solid to the inner wall surface of the discharge container 2 in the extinguished time was measured by the Karl Fischer technique referred to above. Further, the composition ratio of the metal halide was analyzed. Specifically, the composition ratio of the metal halide was measured by the chemical analysis such as an ion chromatography or an IPC method. Table 1 also shows the results of the measurement.

TABLE 1

| | Raw material of metal halide | | | Hg-less metal halide lamp | | |
|---|---|---|---|---|---|---|
| | Water amount (ppm) | Achievement or none of VT treatment | Conditions for VT treatment | Water amount in metal halide (ppm) | Excess amount of metal in metal halide (%)* | Luminous flux maintenance rate after 2000 hours lighting (%) |
| Example 1 | 100 | Achievement | 300° C., 10 min | 50 | 10 | 60 |
| Example 2 | 50 | Achievement | 300° C., 10 min | 20 | 10 | 70 |
| Example 3 | 20 | Achievement | 300° C., 10 min | 10 | 10 | 75 |
| Comparative Example 1 | 500 | None | — | 150 | 0 | 50 |

*average excess amount (%) of metal component relative to stoichiometric composition;

As apparent from Table 1, where the amount of water contained in the metal halide used in the Hg-less metal halide lamp was controlled to 50 ppm or less, it was possible to achieve at least 60% of the luminous flux maintenance rate after the lighting of the metal halide lamp for 2,000 hours. Also, it was possible to further decrease the amount of water contained in the metal halide used in the metal halide lamp by using the raw material of the metal halide subjected to the vacuum heat treatment so as to make it possible to improve the luminous flux maintenance rate. The improvement in the luminous flux maintenance rate is considered to have been affected by the construction that the metal halide was rendered rich in the metal component.

It should be noted that it is difficult at this stage to obtain the raw material of the metal halide having the water content not higher than 100 ppm so as to make it necessary to applying, as required, a dehydrating treatment by heating as described above. However, the raw material of the metal halide containing Zn has a low melting point and a low vapor pressure. Such being the situation, it is necessary to set the conditions which permit the dehydration and which do not cause the evaporation of the component thereof.

In the first step, a vacuum environment having a pressure not higher than 10 Pa was set up by using a vacuum pump, followed by applying a heat treatment. In this case, a component that seemed to be Zn was scattered under temperatures not lower than 300° C. When the components were measured, the composition ratio was found to be different from that in the initial stage, supporting that it would be difficult to carry out the heat treatment under vacuum depending on the components of the chemicals. The results of the measurements were as follows.

Atmosphere condition: Vacuum atmosphere of 10 Pa;
Temperature condition: 350° C.;
Time condition:
60 minutes . . . x (evaporation of white $ZnI_2$);
10 minutes . . . x (evaporation of white $ZnI_2$);
1 minute . . . x (evaporation of white $ZnI_2$);
Atmosphere condition: Vacuum atmosphere of 10 Pa;
Temperature condition: 300° C.;
Time condition:
60 minutes . . . x (evaporation of white $ZnI_2$);
10 minutes . . . x (evaporation of white $ZnI_2$);
1 minute . . . x (evaporation of white $ZnI_2$);

Such being the situation, the dehydration by heating was carried out by introducing Ar in order to prevent the evaporation of the chemicals.

Atmosphere condition: Ar atmosphere of 1 kPa;
Temperature condition: 350° C.;
Time condition:
60 minutes . . . x (evaporation of white $ZnI_2$);
10 minutes . . . Δ (scratching was found);
1 minute . . . ○;
Atmosphere condition: Ar atmosphere of 1 kPa;
Temperature condition: 300° C.;
Time condition:
60 minutes . . . Δ (scratching was found);
10 minutes . . . ○;
1 minute . . . ○;

As apparent from the experimental data, the evaporation of, for example, Zn was suppressed by the introduction of the Ar gas so as to make it possible to apply a high temperature for the dehydration. The amount of water was measured by the Karl Fischer analytical apparatus in respect of the pellets heated under an Ar gas atmosphere at 350° C. It has been found that the water content, which was initially 200 ppm, was lowered to 30 ppm after the heat treatment for 10 minutes. It follows that it is possible to remove water by the heating under an inert gas such as a rare gas.

It should also be noted that the water inside the raw material of the metal halide can be removed by heating the pellets of the raw material of the metal halide put in the discharge container even during the process of manufacturing the metal halide lamp. In this case, the many portion of the evaporated components is deposited within the discharge container, with the result that the change in the component is suppressed even under the somewhat high temperature. In other words, it is effective to put the pellets in the discharge container, followed by sealing an Ar gas under a pressure of several kPa and subsequently heating the pellet portion for several minutes under temperatures of 300° C. to 400° C.

It is possible to decrease the water content of the pellet by the treatment described above. In the embodiment described above, an Ar gas was used as the inert gas. However, the inert gas sealed in the discharge container in the present invention is not limited to the Ar gas. In the present invention, it is effective to carry out the heat treatment under an inert gas atmosphere, particularly, a rare gas atmosphere.

Figure 2:
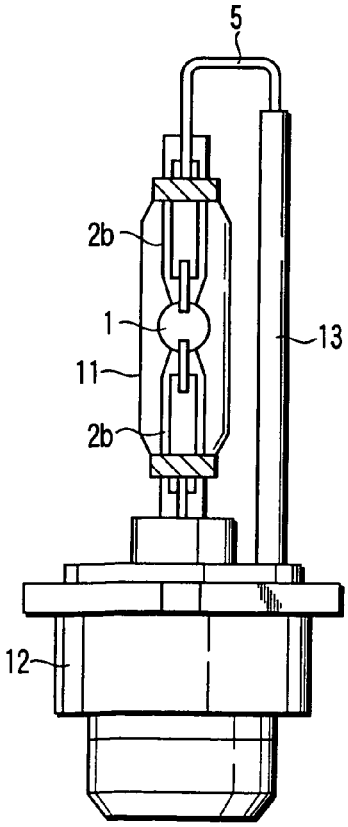
FIG. 2 is a front view exemplifying the construction for applying the metal halide lamp of the present invention to a headlight apparatus for a vehicle.

FIG. 2 is a front view schematically showing the construction of the metal halide lamp according to a second embodiment of the present invention. The second embodiment is directed to the metal halide lamp 1 constructed as shown in FIG. 1 and is modified so as to be adapted for the mounting in a headlight apparatus for a vehicle. The apparatus shown in FIG. 2 comprises an outer tube 11, a metal cap 12, and an insulating tube 13.

The outer tube 11 is allowed to achieve the ultraviolet light cutting performance, and the metal halide lamp 1 constructed as shown in FIG. 1 is housed inside the outer tube 11. The both edges of the outer tube 11 are fixed to the sealing sections 2*b* of the metal halide lamp 1. However, the outer tube 11 is not hermetically closed and is allowed to communicate with the outer atmosphere. One of the sealing sections 2*b* of the metal halide lamp 1 is joined to the metal cap 12. The external lead wire 5 extending from the other sealing section 2*b* is arranged in parallel to the outer tube 11 such that the tip of the external lead wire 5 is introduced into the metal cap 12 so as to be connected to a terminal (not shown). As shown in the drawing, the outer circumferential surface of the external lead wire 5 is covered with the insulating tube 13.

The light emitted from the metal halide lamp 1 is transmitted in a direction opposite to the direction facing the insulating tube 13. It is effective for the insulating tube 13 to be formed of a ceramic tube and to color the ceramic tube black. Where the ceramic tube is colored black, the light emitted from the metal halide lamp 1 is unlikely to be reflected from the ceramic tube so as to suppress the glare caused by the irregular reflection of the light. It is particularly effective to suppress the glare in the case where the metal halide lamp 1 is used in the headlight apparatus for a vehicle. The ceramic tube can be blackened by, for example, the coating of a metal oxide and the calcination of the metal oxide film. Also, it is effective form a light shielding film (not shown) in a desired portion of the outer tube 11.

Figure 3:
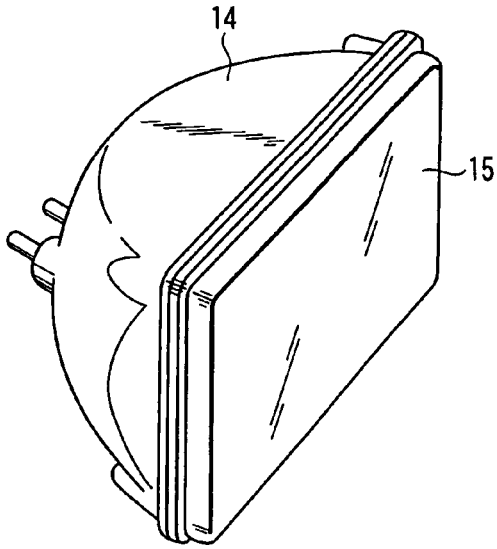
FIG. 3 is an oblique view exemplifying the construction of the headlight apparatus for a vehicle according to the present invention.

FIG. 3 is an oblique view schematically showing the construction of a headlight apparatus for a vehicle according to one embodiment of the present invention. As shown in the drawing, the headlight apparatus comprises a reflector 14 and a front cover 15. The reflector 14 is formed in the shape of a rotary paraboloid of different configurations by the molding of a glass textile and constructed such that the metal halide lamp (not shown) of the construction shown in FIG. 2 can be detached from the back surface in the top portion. On the other hand, a prism or a lens is formed integral with the front cover 15 by the molding of a transparent glass textile, and the front cover 15 of the particular construction is hermetically mounted to the open portion on the front surface of the reflector 14. In the headlight apparatus for a vehicle of the particular construction, the optical axis extends in the longitudinal direction of the discharge container included in the metal halide lamp.

Additional advantages and modifications will readily occur to those skilled in the art. Therefore, the present invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A metal halide lamp, comprising:

a discharge container including a discharge space and sealing sections formed at both edges of the discharge space;

a pair of electrodes arranged to face each other within the discharge space and held in the sealing sections; and a discharge medium sealed in the discharge container, containing a light-emitting material formed of a metal halide and a rare gas, and free from mercury, wherein the amount of water contained in the metal halide in the extinguishing stage of the metal halide lamp is not larger than 20 ppm.

2. A metal halide lamp according to claim 1, wherein the metal halide includes at least a halide of zinc.

3. A metal halide lamp according to claim 1, wherein raw material of the metal halide having a water content not higher than 50 ppm is sealed in the discharge space.

4. A metal halide lamp according to claim 3, wherein a vacuum heat treatment is applied to the raw material of the metal halide.

5. A metal halide lamp according to claim 3, wherein a heat treatment is applied to the raw material of the metal halide under an inert gas atmosphere.

6. A metal halide lamp according to claim 1, wherein the metal halide contains an amount of the metal component more than the stoichiometric amount.

7. A metal halide lamp according to claim 1, wherein the light-emitting material includes a first metal halide formed of a halide of at least one metal selected from the group consisting of sodium, scandium and a rare earth element, and a second metal halide formed of a halide of at least one metal selected from the group consisting of zinc, magnesium, iron, cobalt, chromium, nickel, manganese, aluminum, antimony, beryllium, rhenium, gallium, titanium, zirconium and hafnium.

8. A metal halide lamp according to claim 7, wherein the metal halide includes a halide of at least zinc.

9. A metal halide lamp according to claim 7, wherein the raw material of the metal halide having a water content not higher than 100 ppm is sealed in the discharge container.

10. A metal halide lamp according to claim 9, wherein a vacuum heat treatment is applied to the raw material of the metal halide.

11. A metal halide lamp according to claim 9, wherein a heat treatment is applied to the raw material of the metal halide under an inert gas atmosphere.

12. A metal halide lamp according to claim 7, wherein the metal halide contains an amount of the metal component more than the stoichiometric amount.

13. A headlight apparatus for a vehicle, comprising:

the metal halide lamp according to any one of claims 1 to 12; and a headlight apparatus body for a vehicle having the metal halide lamp arranged therein and having an optical axis extending in the longitudinal direction of the discharge container included in the metal halide lamp.

* * * * *